US012180810B2

(12) United States Patent
Hoelscher et al.

(10) Patent No.: US 12,180,810 B2
(45) Date of Patent: Dec. 31, 2024

(54) ENERGY-ABSORBING IMPACT SLEEVE FOR PERFORATING GUN

(71) Applicant: Halliburton Energy Services, Inc., Houston, TX (US)

(72) Inventors: Christopher C. Hoelscher, Arlington, TX (US); Courtney Ann Thain Roberts, Crowley, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 8 days.

(21) Appl. No.: 17/551,312

(22) Filed: Dec. 15, 2021

(65) Prior Publication Data

US 2023/0184066 A1 Jun. 15, 2023

(51) Int. Cl.

| | |
|---|---|
| ***E21B 43/119*** | (2006.01) |
| ***E21B 43/117*** | (2006.01) |
| ***F42D 1/02*** | (2006.01) |
| ***F42D 5/00*** | (2006.01) |

(52) U.S. Cl.

CPC ..... *E21B 43/119* (2013.01); *E21B 43/117* (2013.01); *F42D 1/02* (2013.01); *F42D 5/00* (2013.01)

(58) Field of Classification Search

CPC ..... E21B 43/119; E21B 43/117; F42D 1/02; F42D 5/00

See application file for complete search history.

(56) References Cited

U.S. PATENT DOCUMENTS

| | | | | |
|---|---|---|---|---|
| 4,877,224 A | | 10/1989 | Watts | |
| 5,598,891 A | * | 2/1997 | Snider | E21B 43/117 166/308.1 |
| 5,619,008 A | * | 4/1997 | Chawla | E21B 43/117 102/307 |
| 5,797,464 A | * | 8/1998 | Pratt | E21B 43/117 175/4.6 |

(Continued)

FOREIGN PATENT DOCUMENTS

| | | |
|---|---|---|
| CN | 101864933 | 10/2010 |
| WO | 2014-003699 | 1/2014 |
| WO | 2016-118179 | 7/2016 |

OTHER PUBLICATIONS

International Search Report and Written Opinion for Application No. PCT/US2021/065817, dated Sep. 1, 2022.

(Continued)

*Primary Examiner* — Yong-Suk (Philip) Ro

(74) *Attorney, Agent, or Firm* — John Wustenberg; C. Tumey Law Group PLLC

(57) ABSTRACT

An impact sleeve is used for mitigating damage in a perforating gun resulting from shaped charge detonation. In one example, a perforating gun includes a gun carrier, with a charge holder and the impact sleeve inside the gun carrier. The charge holder holds a plurality of shaped charges capable of being detonated with sufficient explosive energy to generate high-velocity fragments inside the gun carrier. The impact sleeve comprises an energy-absorbing material and optional raised features for absorbing at least some energy of the high-velocity fragments. The materials, raised features, positioning, and geometry of the impact sleeve and raised features may be tuned to optimize energy absorption.

17 Claims, 5 Drawing Sheets

(56) References Cited

U.S. PATENT DOCUMENTS

| | | | | |
|---|---|---|---|---|
| 6,851,471 | B2 | 2/2005 | Barlow et al. | |
| 8,807,206 | B2 | 8/2014 | Walker | |
| 9,671,201 | B2 | 6/2017 | Marya et al. | |
| 11,156,068 | B2 * | 10/2021 | Robey | E21B 43/117 |
| 11,619,118 | B2 * | 4/2023 | Hardesty | E21B 43/11 403/187 |
| 2004/0216633 | A1 | 11/2004 | Kash | |
| 2005/0200062 | A1 | 9/2005 | Maurer et al. | |
| 2005/0217842 | A1 | 10/2005 | Kash | |
| 2008/0036242 | A1 | 2/2008 | Glance et al. | |
| 2008/0295678 | A1 * | 12/2008 | George | E21B 43/117 89/1.151 |
| 2018/0195372 | A1 | 7/2018 | Robey et al. | |
| 2018/0209251 | A1 * | 7/2018 | Robey | E21B 43/117 |
| 2021/0340823 | A1 | 11/2021 | Lake | |
| 2022/0127935 | A1 * | 4/2022 | Grove | E21B 43/1195 |

OTHER PUBLICATIONS

Robey, Eric; Hoelscher, Chris (). [Society of Petroleum Engineers SPE Deepwater Drilling and Completions Conference—Galveston, Texas, USA (Sep. 14, 2016)] SPE Deepwater Drilling and Completions Conference—Investigation of Shock Wave Interference in Low-Debris Perforating Gun System. SPE-180313-MS.

* cited by examiner

ENERGY-ABSORBING IMPACT SLEEVE FOR PERFORATING GUN

BACKGROUND

After drilling a subterranean wellbore, portions of the wellbore may be reinforced with a casing string that is lowered into the well and cemented in place. This casing string increases the integrity of the wellbore and provides a path for producing fluids from the producing intervals to the surface. However, the casing string must be perforated within the production zone to allow formation fluids to flow into the casing.

To perforate the casing, a string of perforating guns with shaped charges housed in one or more gun carriers is lowered into the well and detonated. Upon detonation, each shaped charge creates a jet to form perforations in the casing. The perforations may extend through the casing, cement and partially into the formation. The perforations thereby serve as hydraulic openings that extend from the formation into the interior of the casing, through which formation fluids may flow into the casing.

When shaped charges are detonated, numerous metal fragments are created due to, among other things, the disintegration of the metal casings of the shaped charges. Perforating guns that are comprised of hollow steel gun carriers are limited by survival of the internal detonation associated with the charges. This dynamic survivability is determined by the structural damage to the gun carrier and the resulting integrity of the carrier. It has been observed that cracking and splitting of the steel carrier is a function of the explosive detonation and the fragment impact of the internal components on to the internal surface of the carrier.

BRIEF DESCRIPTION OF THE DRAWINGS

These drawings illustrate certain aspects of some of the embodiments of the present disclosure and should not be used to limit or define the method.

DETAILED DESCRIPTION

Apparatus and methods are disclosed wherein explosive energy from shaped charge detonation is dissipated and redirected within a gun carrier, providing an armor effect for the inside surface of the carrier. In examples, a sleeve (referred to as the "impact sleeve") is positioned inside a gun carrier to absorb at least some of the energy of high-velocity fragments generated upon detonation of shaped charges. The impact sleeve may be radially positioned between the carrier ID and the charge holder in one example configuration, or radially inward of the charge holder in another configuration. The impact sleeve may be of a material and/or shape that absorbs energy of high-velocity fragments that are generated in response to detonation, such as from fracturing of charge cases and surrounding components. The impact sleeve may absorb the energy, in part, by having the fragments directly impact the impact sleeve rather than (or prior to) impacting other components such as the gun carrier and charge holder. The impact sleeve may be of a different material than the charge carrier. For example, whereas a parent material of the gun carrier may be a stiff material to provide necessary structural support for the perforating gun and connection to other perforating guns, a parent material of the impact sleeve material may be a softer and more ductile material, to sacrificially deform and absorb energy by virtue of deformation.

The impact sleeve may have any of a variety of different configurations, including various shapes and geometries. Even a smooth impact sleeve positioned inside the gun carrier as taught herein is beneficial in terms of being a sacrificial member to deform and absorb energy. The impact sleeve may additionally be fabricated with formed features that increases the energy absorption. Example of such features include dimples or a corrugated (e.g., wave) pattern that is formed in the impact sleeve. The impact sleeve may be formed, for example, by stamping a sheet metal strip with the desired impact-absorbing features and then rolled to create a helical seam. The seam may be bonded, such as by welding. This helical rolling process enables a very efficient means to create a impact sleeve of any diameter by adjusting the helix angle. The tubular impact sleeve then can be either attached to the charge tube holder or to the alignment fixture(s) of the gun system.

Figure 1:
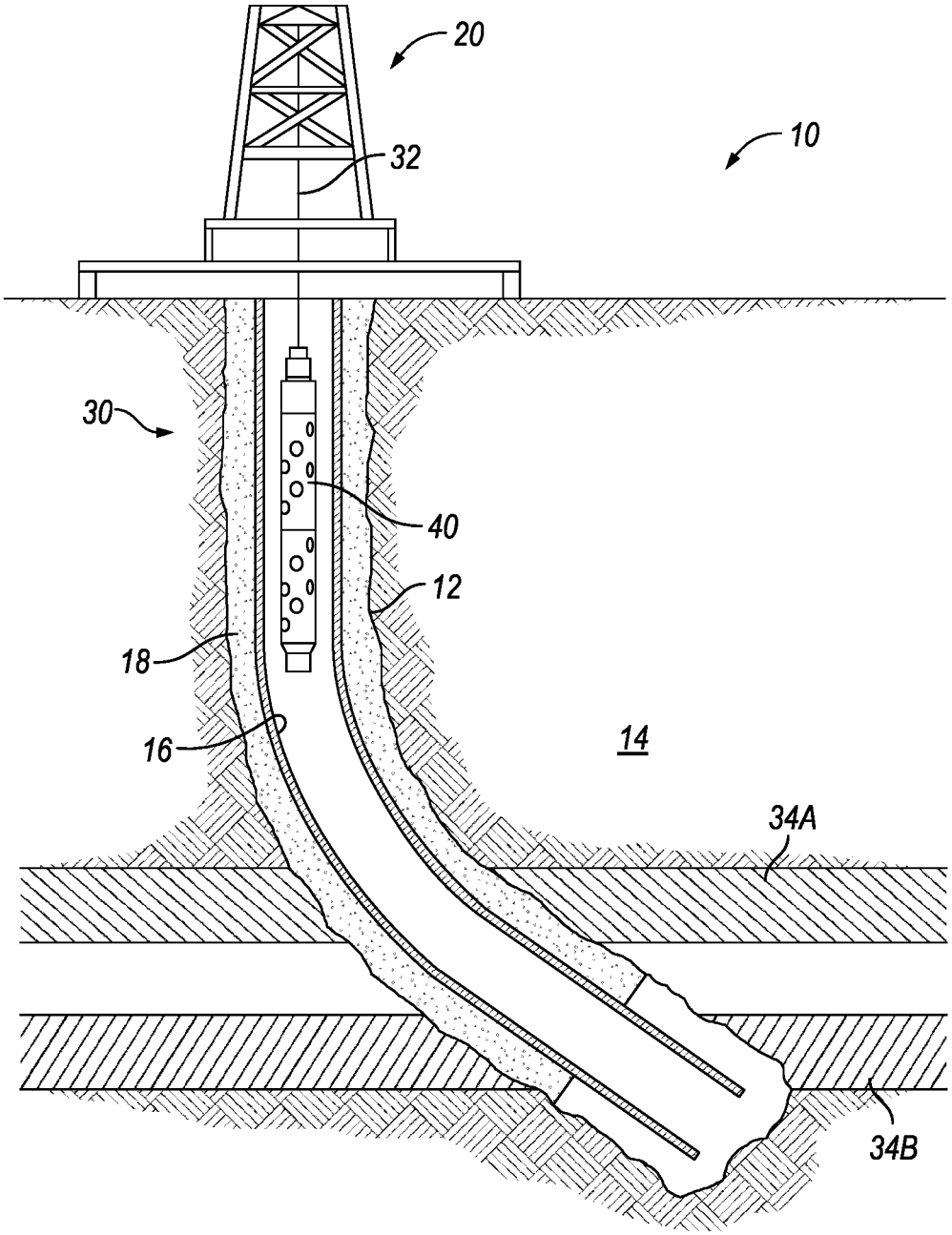
FIG. 1 is a schematic view of an embodiment of a wellbore operating environment in which a perforating gun may be deployed.

FIG. 1 is a schematic view of an embodiment of a wellbore operating environment in which a perforating gun may be deployed. As depicted, the wellbore operating environment 10 comprises a service rig 20 that extends over and around a wellbore 12 that penetrates a subterranean formation 14 for recovering hydrocarbons from a production zone 34A and/or 34B, collectively the production zones "34". The wellbore 12 may be drilled into the subterranean formation 14 using any suitable drilling technique. While shown as extending vertically from the surface in FIG. 1, directional drilling techniques may be employed such that the wellbore 12 may deviate from vertical and follow any given wellbore path. For example, the wellbore 12, or a lateral wellbore drilled off of the wellbore 12, may deviate and remain within one of the production zones 34. The wellbore 12 may be cased, open hole, contain tubing, and may generally be made up of a hole in the ground having a variety of shapes and/or geometries as is known to those of skill in the art. In the illustrated embodiment, a casing 16 may be placed in the wellbore 12 and secured at least in part by cement 18.

The servicing rig 20 may be, for example, a drilling rig, a completion rig, a workover rig, and includes a mast or other large support structure that supports a workstring 30 in the wellbore 12. The servicing rig 20 may also comprise a derrick with a rig floor through which the workstring 30 extends downward from the servicing rig 20 into the wellbore 12. In some cases, such as in an off-shore location, the servicing rig 20 may be supported by piers extending downwards to a seabed. Alternatively, the servicing rig 20 may be supported by columns sitting on hulls and/or pontoons that are ballasted below the water surface, which may be referred to as a semi-submersible platform or rig. In an off-shore location, a casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, another servicing vehicle, a coiled tubing unit and/or other apparatus.

As illustrated, the workstring 30 may include a conveyance 32 and a perforating gun 40 being lowered into the wellbore 12 on the conveyance 32. Although just one perforating gun is shown there may be a string of interconnected perforating guns, axially arranged. The conveyance 32 may be any of a string of jointed pipes, a slickline, a coiled tubing, and a wireline. In other examples, the workstring 30 may further contain one or more downhole tools (not shown in FIG. 1), for example above the perforating gun 40. The workstring 30 may have one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to position the perforating gun 40 with respect to the production zones to perforate the casing 16 in the vicinity of one or more of the production zones 34.

Figure 2:
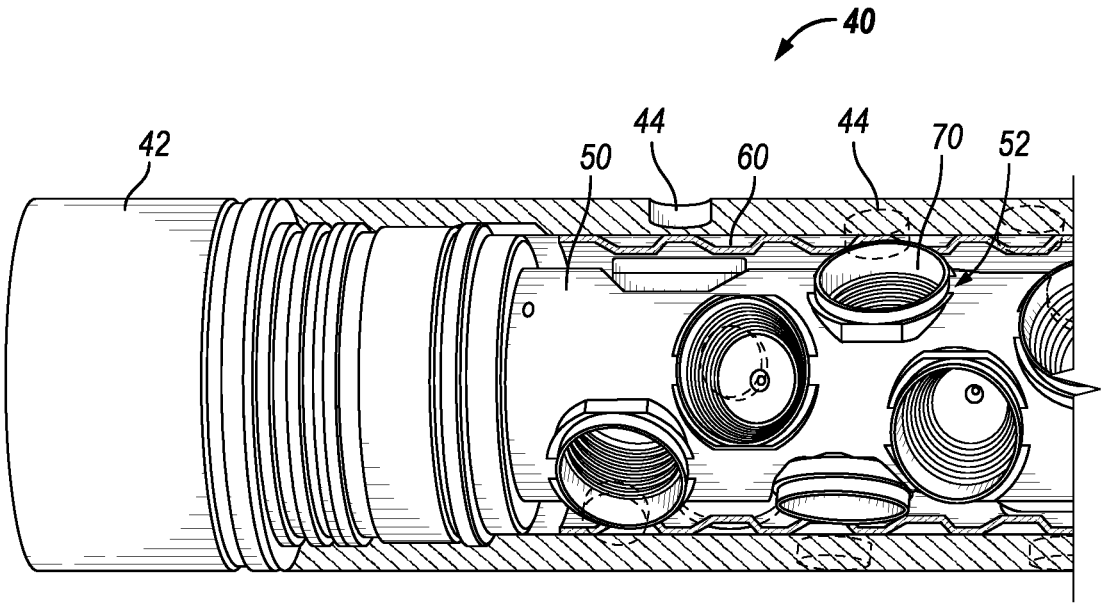
FIG. 2 is partial cutaway view of the perforating gun according to one example configuration.

FIG. 2 is partial cutaway view of the perforating gun 40 according to one example configuration. Components of the perforating gun 40 can be assembled in the field. The main components of the perforating gun 40 include a gun carrier 42, a charge holder 50, an impact sleeve 60, and a plurality of shaped charges 70. The gun carrier 42 may serve as an outer structural housing for the perforating gun 40, which may protect components inside the gun carrier 42. The gun carrier 42 also serves as a structure for securing the components inside the gun carrier 42, and for coupling any number of the perforating guns 40 within a perforating gun string. The gun carrier 42 is typically a rigid, strong, tubular construction, which may be formed of a metallic material such as steel. The slim, tubular form factor of the gun carrier 42 may fit well within a wellbore or other tubulars through which the perforating gun 40 must pass as it is lowered into the wellbore and subsequently removed from the wellbore. The gun carrier 42 may be used to couple the perforating gun 40 to any suitable conveyance, such as wireline, a tubing string, or coiled tubing.

The charge holder 50 is disposed inside the tubular gun carrier 42 and may be inserted into the charge tube 50 as part of the assembly of the perforating gun 40. The charge holder 50 functions to hold the plurality of shaped charges 70 at predefined positions and orientations. In this example, the charge holder 50 is a generally continuous structure in the form of a tube, in which configurations it may be alternatively referred to as a charge holder tube. In other configurations, a charge holder may be comprised of any number of charge holder segments that can be interconnected to secure the shaped charges 70 at the predefined positions and orientations. The charge holder 50 has a plurality of mounting holes 52. Each mounting hole 52 may receive a respective shaped charge 70. When so mounted, each shaped charges 70 is positioned so that a central axis of the shaped charge 70 is generally oriented outwardly for firing toward a casing.

In assembling the perforating gun 40, the shaped charges 70 may be assembled to the charge holder 50, such as with a flanged and/or threaded connection. The charge holder 50 with shaped charges 70 secured thereto may then be inserted into the gun carrier 42, for example, using a gun loader. Each charge holder is assembled, for example by adding the shaped charges 70, and optionally connecting the shaped charges 70 with a wiring (not explicitly shown). Then the charge tube 50 may be inserted into the gun carrier 42, aligning the axes of the shaped charges 70 with corresponding exit holes (i.e., "scallops") 44 on the gun carrier 42. The scallops 44 provide a pathway for the shaped charges 70 to fire through the gun carrier 42. The gun carrier 42 and charge holder 50 are generally designed to survive multiple perforating operations. However, the explosive energy generated by the shaped charges 70 does result in a significant shock to the various components of the perforating gun 40, including the generation of high-velocity fragments inside the gun carrier 42. The impact sleeve 60 according to this disclosure is disposed within the gun carrier 42 to absorb at least some of the energy and impacts that would otherwise be transmitted directly to components such as the gun carrier 42 and charge holder 50.

Figure 3:
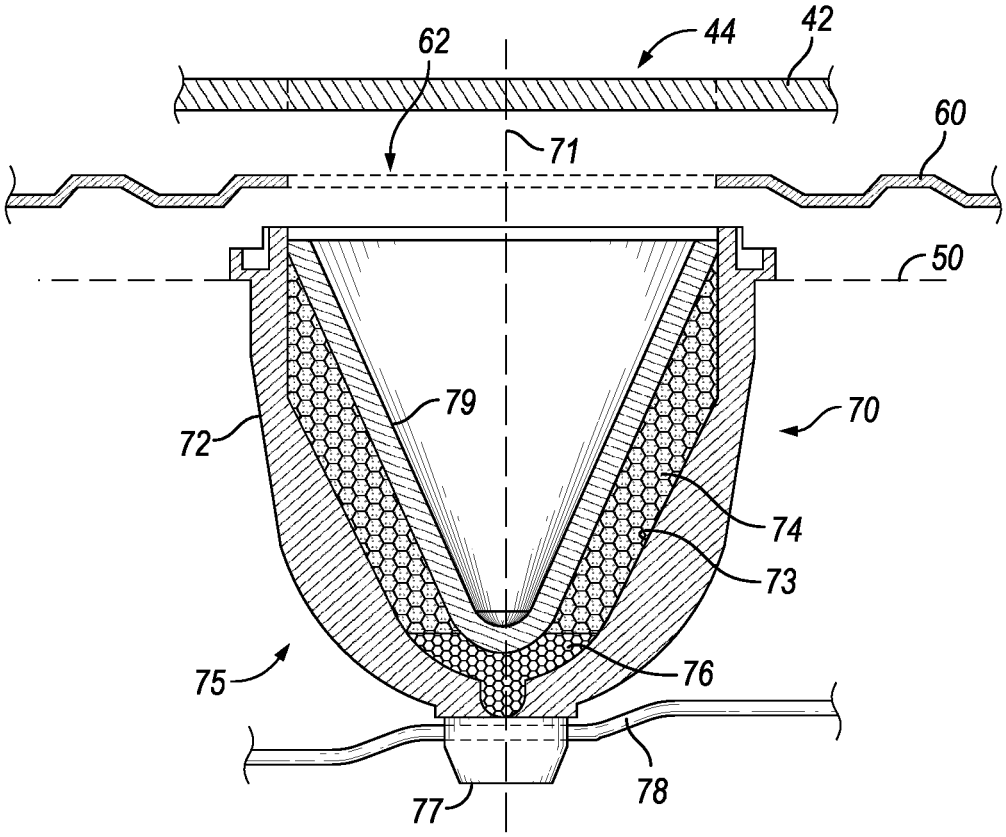
FIG. 3 is a cross-sectional view of one of the shaped charges according to an example configuration.

FIG. 3 is a cross-sectional view of one of the shaped charges 70 according to an example configuration. The shaped charge 70 includes a structural charge case 72 having a generally concave interior 73. The charge case 72 may have a round cross-section defining a central axis 71. An explosive charge 74 is disposed within, and conforms to the shape of, the concave interior 73 of the charge case 72. A liner 79 is disposed over the explosive charge 74. Within the concave interior 73, there may also be a booster 76 at an initiation end 75. The booster 76 is generally configured to aid in transferring the explosive detonation from a detonating cord 78 to the explosive charge 74. The booster 76 may be triggered by the detonating cord 78. A passageway may be formed in a base 77 of the charge case 72 for receiving and retaining the detonating cord 78 in a configuration for passing the explosive detonation from the detonating cord 78 to the booster 76 and thereby to the explosive charge 74.

The impact sleeve 60 in this example is radially between the charge holder 50 and the gun carrier 42. The shaped charge 70 generally fires along the axis 71, which may be directed through a respective opening 62 optionally included on the impact sleeve 60 and through a scallop 44 on the gun carrier 42. The impact sleeve 60 has raised features embodied here as a corrugated or wave pattern. The raised features may help absorb energy from detonation.

Figure 4:
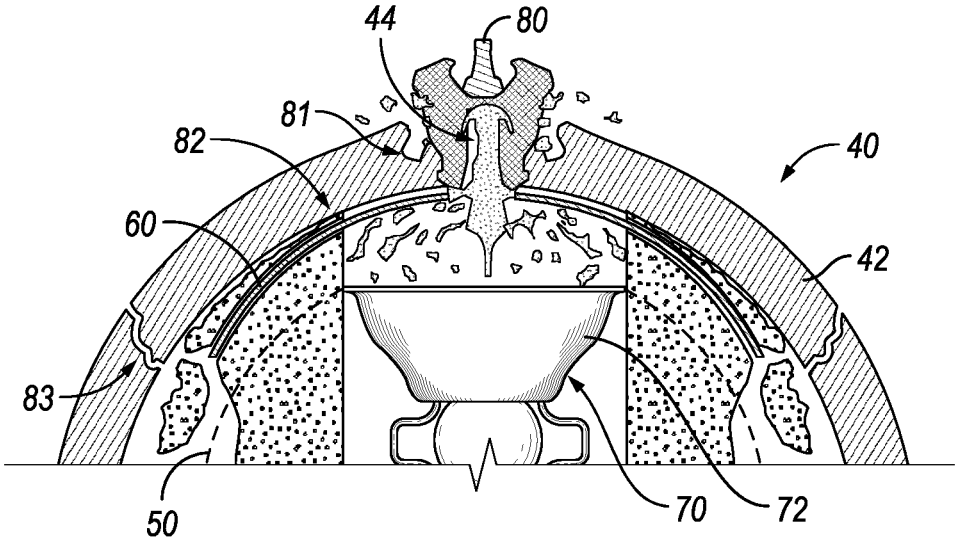
FIG. 4 is a side view of a representative shaped charge being fired to illustrate various types of damage to be mitigated by the impact sleeve.

FIG. 4 is a side view of a representative shaped charge 70 being fired to illustrate various types of damage to be mitigated by the impact sleeve 60. Upon detonation, the shaped charge 70 creates a jet 80 that blasts through the impact sleeve 60 and the scallop 44 in the gun carrier 42. The jet 80 creates a hydraulic opening through a casing, cement, and formation (not explicitly shown) to form a perforation. The shaped charge 70 is detonated with sufficient explosive energy to generate high-velocity fragments inside the gun carrier. These numerous metal fragments are created due to, among other things, the disintegration of the charge case 72. The shaped charge 70 detonation may create a pressure wave, which may be a shock wave, that propels these fragments. As such, these fragments become high-velocity projectiles. The term "high-velocity" in this context is a speed and a corresponding energy sufficient to damage internal components of the perforating gun. The magnitude of fragment velocity can be on the order of several hundred meters per second in a typical case. For example, an explosive charge with a 150-gram charge case, 15 grams of high-melting explosive (HMX) assuming 5.5 kJ/g detonation energy, wherein 40% of the explosive energy converts to case kinetic energy, could generate fragment velocity on the order of 600 to 700 meters per second.

The possible damage caused by the high-velocity fragments in the absence of the impact sleeve 60 may occur anywhere within the perforating gun 40, but may be concentrated in certain areas, particularly along the gun carrier 42. Possible damage locations may depend on variables such as the configuration of the perforating gun 40, the placement and spacing of the shaped charges 70, the explosive material selected, the downhole environment, the geometry of the various components, and so forth. Several examples of possible damage (including possible failure) are illustrated in the figure, which may be avoided or mitigated by the impact sleeve 60. For example, damage may occur at a first location 81, which is at the scallop 44 on the inside of the gun carrier 42. Damage may also occur at a second location 82, just outside the scallop 44. Damage may occur at a third location 83, which may include bending just outside of charge holder 50. These various examples of damage are mitigated either by forcing the high-velocity fragments to impact the impact sleeve 60 and absorb at least some of the kinetic energy of those fragments, rather than directly impacting the component (e.g., gun carrier 42 or charge holder 50) that would otherwise be directly impacted and damaged in the absence of the impact sleeve 60. Some fragments may possibly ricochet inside the perforating gun 40 and strike internal components other than the impact sleeve 60, but those impacts and energy can be at least partially absorbed by the impact sleeve 60.

An impact sleeve according to this disclosure may be configured to absorb energy by virtue of material selection and/or raised features on the impact sleeve. Even a smooth impact sleeve may absorb energy if formed from a parent material that is a relatively soft, ductile material as compared with a parent material of the gun carrier. The parent material may sacrificially deform in response to a pressure wave and/or impact by high-velocity fragments. The impact sleeve may also comprise a polymer or plastic material. Materials such as ballistic nylons, para-aramids, and similar, weaved materials may also be incorporated into the impact sleeve. These materials can be formed as the impact sleeve by means of a wrapping over the charge tube assembly or as a free sleeve/tube. The impact sleeve may be incorporated/integrated with the charge tube. The impact sleeve may be optimized for specific charges to provide for the jet being formed in front of the charge opening through the carrier wall. The impact sleeve may also be sub-sized, as further discussed in examples below, internal to the charge holder tube and fit in between the charges.

Raised features may be added to the impact sleeve to help absorb some of the impacts and energy associated therewith. Examples of raised features include dimples and/or a corrugated/wave pattern as further discussed below. For some sleeve materials, forming the raised features may work harden the material in the vicinity of the raised features to locally modify material properties in or adjacent to the raised features.

Various parameters may be selected to tune energy absorption, taking into account a particular perforating gun configuration or expected dynamics of detonation. For example, an expected mean particle size and velocity may be determined for a particular perforating environment and model of perforating gun. The dynamics of the pressure wave to be generated may also factor into the gun design. The choice of sleeve materials, the geometry of the raised features, and the positioning and geometry of the impact sleeve are some of the parameters that may be tuned to optimize energy absorption.

Figure 5:
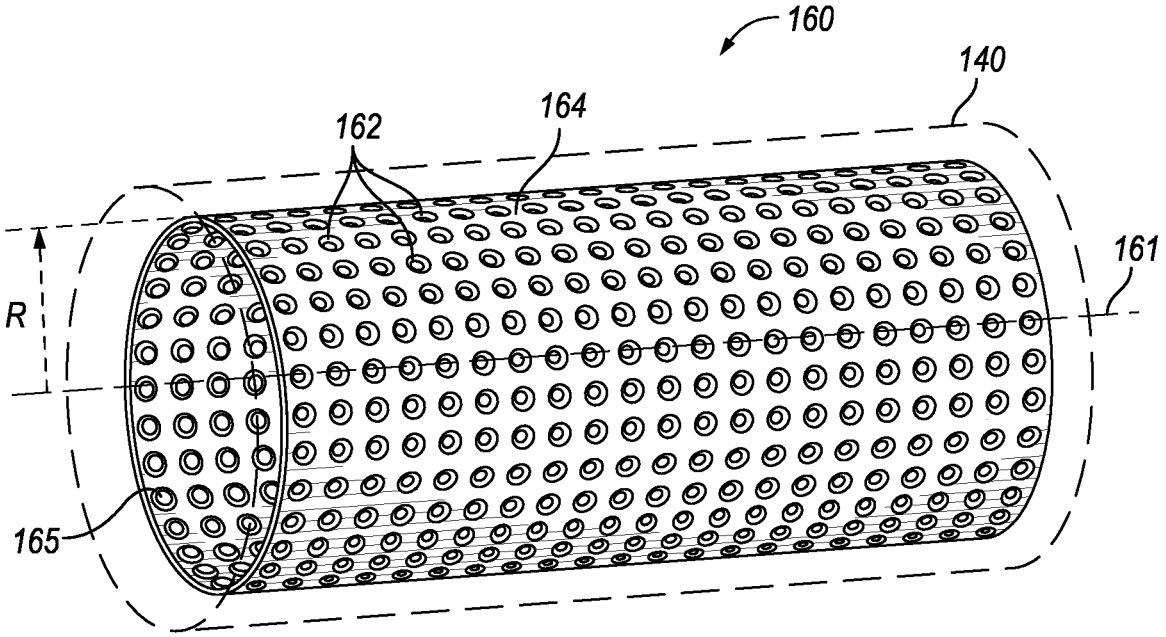
FIG. 5 is a perspective view of an impact sleeve according to an example configuration having a plurality of dimples axially and circumferentially spaced along the impact sleeve.

FIG. 5 is a perspective view of an impact sleeve 160 according to an example configuration having a plurality of dimples 162 axially and circumferentially spaced along the impact sleeve 160. The impact sleeve 160 may have a generally circular profile as shown, with a radius "R" from a central axis 161. The central axis 161 may align with corresponding axis of a gun carrier and charge holder, i.e., these components may be co-axial. The dimples 162 are raised in the sense that they extend radially (in either direction) with respect to a circular impact sleeve body 164 having the circular profile and radius R. In this example, the dimples 162 extend radially inward toward the axis 161. If the impact sleeve 160 is positioned radially outwardly from a tubular charge holder (e.g., FIG. 2) then impacts from fragments of the charge cases may impact the raised portions 165 internal to the tubular impact sleeve body 164. The raised portions 165 have room, in a radial direction with respect to axis 161, to deform (radially outwardly in this case), without necessarily deforming radially past the outer diameter (OD) of the impact sleeve body 164. Thus, the raised portions 165 may absorb impacts and impact energy of high-velocity fragments moving radially outwardly into collision with the impact sleeve 160 before reaching (or avoiding reaching) the gun carrier 40.

The size and spacing of the dimples 162 may be selected as part of the design, taking into variables associated with a particular perforating gun configuration or expected dynamics of detonation. For example, an expected mean particle size and velocity may be determined for a particular perforating environment and model of perforating gun. The diameter and height of the dimples 162 and a spacing (circumferential or axial) between adjacent dimples 162 may be selected according to the particle size and velocity. In one example, larger expected particles may requires taller and/or wider dimple size, whereas smaller expected particles may require a larger number and/or more closely spaced dimples 162. Taller and wider dimples have a greater impact area and provide a larger cross section area for the deflection of the sleeve material. The smaller dimples have a smaller impact area. If necessary, the smaller dimples can be arranged in a higher density pattern so that the dimples are more closely spaced. The smaller dimple size tends to create a stiffer cross section of material in the impact sleeve which is favorable for higher velocity impacts created by smaller particle impacts.

Figure 6:
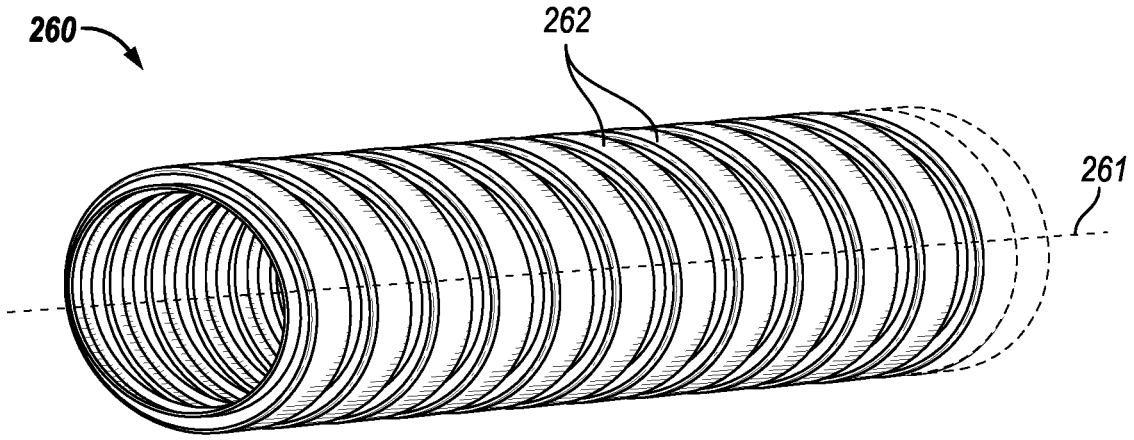
FIG. 6 is a perspective view of an impact sleeve according to another example configuration having a corrugated pattern of raised ridges.

FIG. 6 is a perspective view of an impact sleeve 260 according to another example configuration having a corrugated pattern of raised ridges 262. The impact sleeve 260 may have a generally circular profile as shown about a central axis 261. The central axis 261 may align with corresponding axis of an optionally-circular gun carrier (e.g., FIG. 2). As with the dimples of FIG. 5, the ridges 262 in this example of FIG. 6 are raised in the sense that they extend radially (in either direction) with respect to the central axis 261. The corrugated pattern would have a wave-like pattern if viewed in a cross-sectional plane containing the central axis 261 (e.g., see FIG. 8), where the wave may be described as undulating radially along an axial direction. The ridges 262 may deform to absorb fragment impacts and the energy of those fragment impacts. The size and spacing of the ridges 262 is schematically shown and not to scale in FIG. 6. Those parameters may be selected as part of the design, taking into variables associated with a particular perforating gun configuration or expected dynamics of detonation. For example, an expected mean particle size and velocity may be determined for a particular perforating environment and model of perforating gun. The height and axial spacing between adjacent ridges 262 may be selected according to the particle size and velocity. In one example, larger expected particles may require taller and/or wider ridges, whereas smaller expected particles may require a larger number and/or more closely spaced ridges 262.

Figure 7:
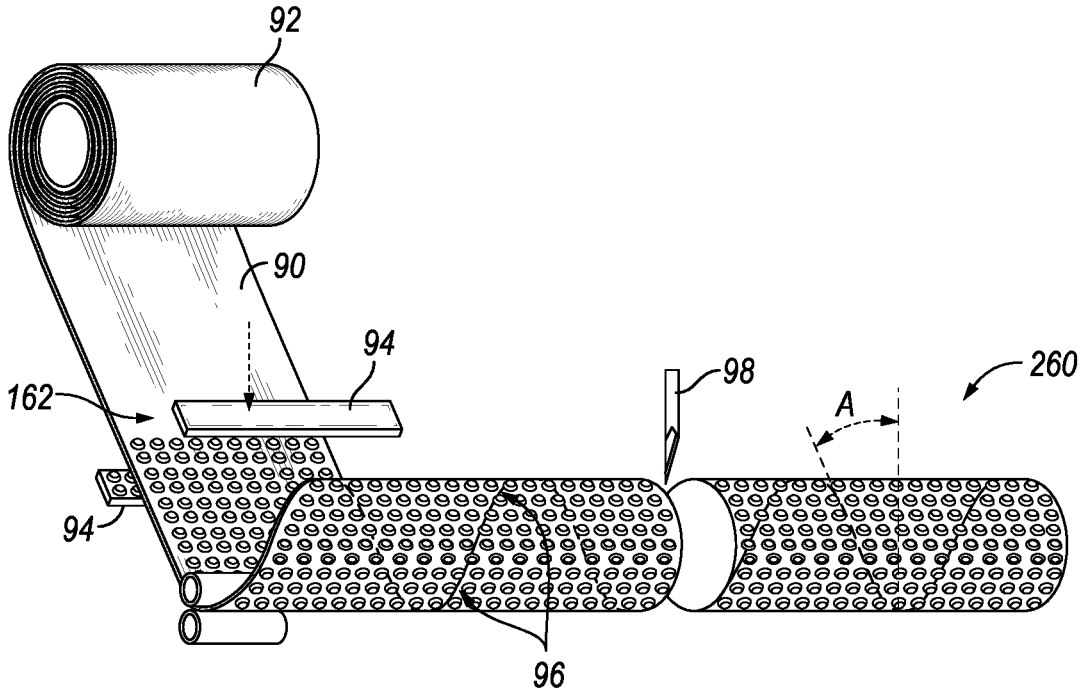
FIG. 7 is a diagram illustrating an example method of forming the impact sleeve.

FIG. 7 is a diagram illustrating an example method of forming the impact sleeve 60. The impact sleeve 60 may be formed in this example from a flat sheet 90 of ductile material, such as a ductile metal. The sheet 90 may be initially stored or supplied in a roll 92 of material. The sheet 90 may be fed through opposing platens 94 or other forming mechanism (e.g., rollers) with the complement of a shape of the desired raised features to stamp or otherwise form a pattern of the raised features (e.g., dimples 162 as shown or a corrugated/wave pattern). Then, the sheet 90 with formed features may be helically rolled into a tube shape of the desired diameter, as shown, to create a helical seam 96. The helical seam may be bonded, such as by welding. Long helical tubes may be formed and then cut to desired lengths by a cutting tool 98 (e.g., saw or laser). This helical rolling process enables a very efficient means to create an impact sleeve 60 of any diameter by adjusting a helix angle "A." However, any suitable manufacturing technique may be used to form a tubular impact sleeve with raised features. The tubular impact sleeve 60 then can be either attached to the charge tube holder or to the alignment fixture(s) of the gun system.

In addition to material selection, selection of surface features, and geometry of the impact tube and surface features as discussed above, another parameter that may be selected to tune energy absorption is the diameter and relative placement of the impact sleeve within the perforating gun. The impact sleeve, charge holder, and gun carrier may be generally coaxial as illustrated in foregoing figures. The diameter of the impact sleeve and thus a radial spacing of these three main components with respect to each other may be selected according to where the energy or high-velocity fragment impacts are expected to be concentrated. This selection may depend, in part, on the expected pressure wave generated by detonation of shaped charges, which may vary based on gun design. High strength low alloy steel such as ASTM 4130 is commonly used for the perforating gun. So, in general a material of lower tensile strength and greater ductility is desired for the impact sleeve. The fragments of the shaped charge case also vary in material selection. Common charge case materials are zinc, aluminum, low and high strength steels. However, an impact sleeve made of a higher strength material may be selected for a system that incorporates a relatively low strength charge case material such as zinc. In this situation the relative differences in material hardness provide the beneficial absorption of energy within the system. Examples of impact sleeve mounting, along with associated radial placement and radial spacing between components, are provided in FIGS. 8 and 9.

Figure 8:
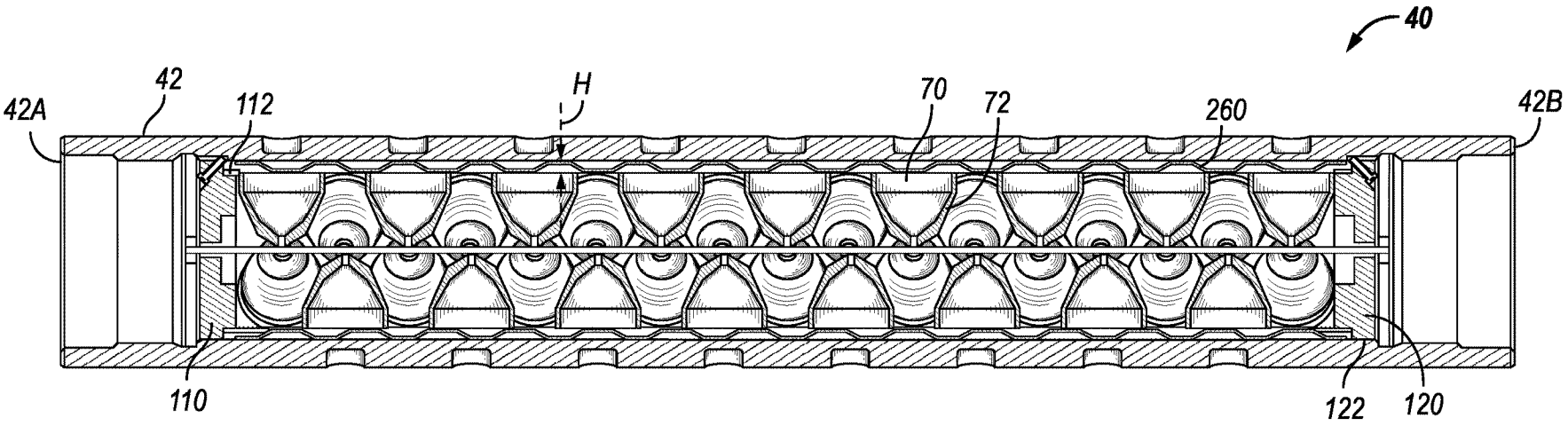
FIG. 8 is a sectional view of one example configuration of the perforating gun wherein an impact sleeve having a corrugated/wave pattern is positioned radially between the gun carrier and the charge holder.

FIG. 8 is a sectional view of one example configuration of the perforating gun 40 wherein an impact sleeve 260 having a corrugated/wave pattern is positioned radially between the gun carrier 42 and the charge holder 50. The perforating gun 40 includes a first alignment fixture 110 at a first end 42A of the gun carrier 42 and a second alignment fixture 120 at an opposing second end 42B of the gun carrier 42. Each alignment fixture 110, 120 includes a radially outwardly-facing shoulder 112, 122 for supporting the charge holder 50 and the impact sleeve 260 at their respective first and second opposing ends, radially positioning the impact sleeve 260 between the gun carrier 42 and the charge holder 50. The alignment fixtures 110, 120 thereby secure the charge holder 50 and the impact sleeve 260 in a concentric relationship to the gun carrier 42. The wave pattern of the impact sleeve 260 also slightly radially spaces the charge holder 50 from the gun carrier 42 a distance equal to a height "H" of the wave pattern.

Upon detonation, the charge cases 72 and other components may fragment. The impact sleeve 60 absorbs some of the impacts and associated energy of the high-velocity fragments. In the FIG. 8 configuration, high-velocity fragments that are directed radially outwardly from the shaped charges 70 will therefore strike the impact sleeve 60 rather than striking the charger carrier 42 directly. Fragments directly radially inwardly may strike another part of the impact sleeve 60. The impact sleeve 60 thus protects the charge carrier 42 from impact damage. The impact sleeve 60 may also absorb at least some of the energy to reduce damage to other components as well. Furthermore, the wave pattern of the impact sleeve 260 and the associated radial spacing between the charge holder 50 and gun carrier 42 helps to cushion the gun carrier 42 from the impacts of the fragments against the impact sleeve 260.

Figure 9:
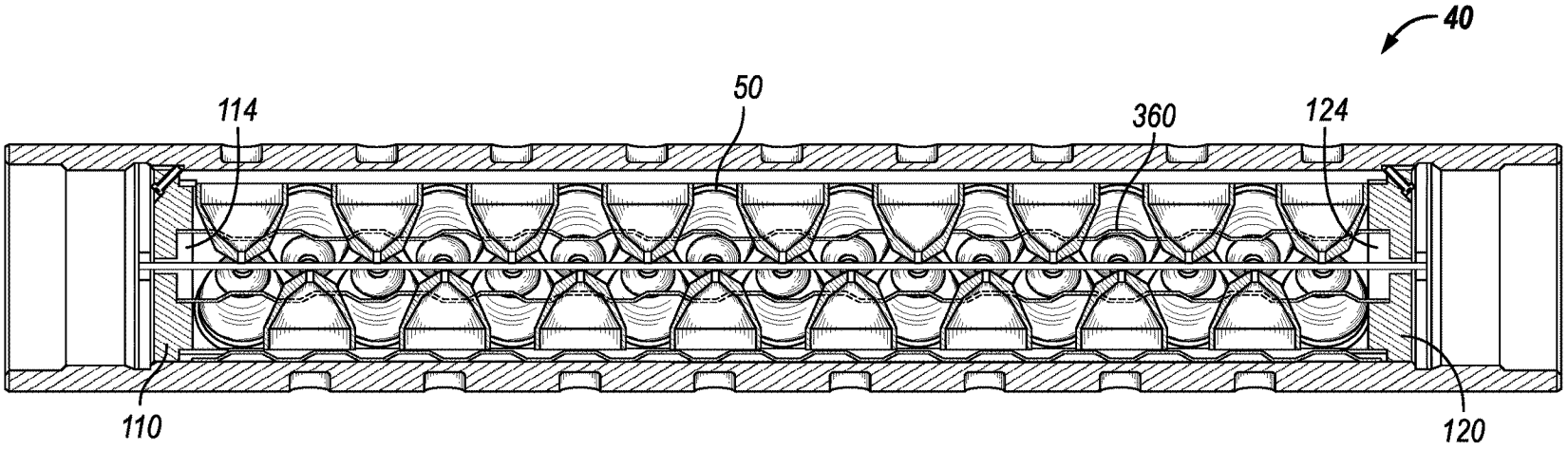
FIG. 9 is a sectional view of another example configuration of the perforating gun wherein an impact sleeve is disposed radially inward of the charge holder.

FIG. 9 is a sectional view of another example configuration of the perforating gun 40 wherein an impact sleeve 360 is disposed radially inward of the charge holder 50 (or at least radially inward of an OD of the charge holder 50). The impact sleeve 360 has a smaller diameter and a less prominent corrugated/wave pattern than the impact sleeve of FIG. 8. The alignment fixtures 110, 120 each comprise a central recess 114, 124 for receiving and supporting the respective end of the impact sleeve 360. This positions the narrower impact sleeve 360 radially inward of the charge holder 50 or at least an OD of the charge holder 50. This alternative example positioning of the impact sleeve 360 may help absorb impact and associated energy that are directed radially inwardly and/or more concentrated at radially inward locations. In some perforating gun embodiments, the pressure wave may be at its highest at these radially inward locations, so that this placement of the impact sleeve 360 is more optimal for those embodiments in terms of absorbing associated impacts and/or energy.

An overview of a detonation event provides an understanding of why the pressure wave may be higher in some scenarios at these radially inward locations. The detonation event propagates with the sudden and rapid expansion of the explosive material, which generates pressure waves that continue to expand. The expanding pressure wave within each charge primarily travels along the central axis of the charge from initiation point to the open outward end of the charge. This wave simultaneously expands radially transverse to the axis of the charge. This transverse expansion applies pressure on the charge case material. The charge case expanse in response to the applied pressure. The stresses resulting from the applied pressure wave exceeds the strength of the charge case. The charge case yields to the point of fragmentation and some case material fragments continue as part of the explosive pressure waves inside the gun. It is observed that the area within the inner two-thirds of the inside diameter of a particular configuration of perforating gun systems can account for some of the highest energy of the detonation.

Furthermore, some charge cases by nature of the geometrical design can be predisposed to fracture so that the portion of the charge that is relatively closer to the axis of the gun will fracture in a manner that results in high-velocity fragments. In this type of configuration, the positioning of the impact sleeve inside the charge holder optimizes the functionality of absorbing energy of the fragments.

Another situation in which an impact sleeve is desired to be inside the charge holder is the situation in which the arrangement of the charges inside the gun creates subsequent directed detonation wave of energy. This focus or directed energy is explained by the Munroe Effect. The spacing and arrangement of charges in a perforating gun may provide the defining cavity area on the backside of the charges. Thus the charge case material is jetted by the focused blast energy for the explosive material inside each charge.

Accordingly, the present disclosure provides apparatus and methods involving the use of an impact sleeve for mitigating damage in a perforating gun. In one example, a perforating gun includes a gun carrier, with a charge holder and the impact sleeve inside the gun carrier. The charge holder holds a plurality of shaped charges capable of being detonated with sufficient explosive energy to generate high-velocity fragments inside the gun carrier. The impact sleeve comprises an energy-absorbing material and optional raised features for absorbing at least some energy of the high-velocity fragments. The materials, raised features, positioning, and geometry of the impact sleeve and raised features may be tuned to optimize energy absorption.

The methods/systems/compositions/tools may include any of the various features disclosed herein, including one or more of the following statements.

Statement 1. A perforating gun, comprising: a gun carrier; a charge holder inside the gun carrier having a plurality of mounting holes for mounting respective shaped charges configured for being detonated with sufficient explosive energy to generate high-velocity fragments inside the gun carrier; and an impact sleeve inside the gun carrier configured for absorbing at least some energy of the high-velocity fragments.

Statement 2. The perforating gun of Statement 1, wherein the impact sleeve is radially positioned between the gun carrier and the charge holder to prevent a direct impact of the high-velocity fragments with the gun carrier.

Statement 3. The perforating gun of Statement 1 or 2, wherein the impact sleeve is positioned radially inward of the charge holder.

Statement 4. The perforating gun of any of Statements 1-3, further comprising: a first alignment fixture at a first end of the gun carrier supporting a first end of the charge holder and a first end of the impact sleeve; and a second alignment fixture at a second end of the gun carrier supporting a second end of the charge holder and a second end of the impact sleeve.

Statement 5. The perforating gun of Statement 4, wherein the alignment fixtures each comprise a shoulder for supporting the impact sleeve between the gun carrier and the charge holder.

Statement 6. The perforating gun of Statement 4 or 5, wherein the alignment fixtures each comprise a central recess for supporting the respective end of the impact sleeve radially inward of the charge holder.

Statement 7. The perforating gun of any of Statements 1-6, wherein the impact sleeve comprises a sleeve diameter and a plurality of raised features axially spaced along the sleeve and radially extending from the sleeve diameter.

Statement 8. The perforating gun of Statement 7, wherein the raised features comprise work-hardened deformations of a parent material of the impact sleeve.

Statement 9. The perforating gun of Statement 7 or 8, wherein the impact sleeve comprises a sheet of impact-absorbing material helically formed into a tubular shape of the impact sleeve.

Statement 10. The perforating gun of any of Statements 7-9, wherein the raised features engage a diameter of the charge holder tube, thereby radially spacing the sleeve diameter from the charge holder.

Statement 11. The perforating gun of any of Statements 7-10, wherein the raised features comprise axially and circumferentially-spaced dimples.

Statement 12. The perforating gun of Statement 11, wherein the dimples comprise one or more of a diameter, a height, and a spacing selected according to an expected particle size and velocity.

Statement 13. The perforating gun of any of Statements 1 to 12, wherein a parent material of the impact sleeve comprises a greater ductility than a parent material of the gun carrier.

Statement 14. A perforating gun, comprising: a gun carrier; a charge holder inside the gun carrier, the charge holder having a plurality of mounting holes for receiving respective shaped charges; an impact sleeve inside the gun carrier, the impact sleeve comprising a sleeve diameter and a plurality of raised features radially extending from the sleeve diameter for absorbing at least some energy of moving particles generated in response to detonation of the charges, wherein a parent material of the impact sleeve comprises a different ductility or toughness than a parent material of the gun carrier; and an alignment fixture at opposing ends of the gun carrier supporting respective ends of the charge holder and the impact sleeve.

Statement 15. A method of perforating a well, comprising: positioning a plurality of shaped charges downhole, spaced apart on a charge holder inside a gun carrier; detonating the shaped charges with sufficient power to perforate a casing and generate explosive fragments inside the gun carrier; and impacting the explosive fragments with a sleeve comprising an energy-absorbent material inside the gun carrier to reduce an amount of kinetic energy imparted from the explosive fragments to one or both of the charge holder and the gun carrier.

Statement 16. The method of Statement 15, further comprising positioning the sleeve radially between the gun carrier and the charge holder to absorb the kinetic energy of a portion of the explosive fragments moving radially outwardly toward the gun carrier.

Statement 17. The method of Statement 15 or 16, further comprising positioning the sleeve radially inward of the charge holder to absorb the kinetic energy of a portion of the explosive fragments moving radially inwardly away from the gun carrier.

Statement 18. The method of any of Statements 15-17, wherein impacting the explosive fragments with the sleeve comprises impacting the explosive fragments against a plurality of raised features axially spaced along the sleeve.

Statement 19. The method of Statement 18, further comprising using the raised features to radially space the sleeve from the charge holder tube.

Statement 20. The method of any of Statements 15-19, further comprising selecting one or more of a diameter, a height, and a spacing between the raised features according to an expected particle size and velocity.

To facilitate a better understanding of the present invention, the following examples of certain aspects of some embodiments are given. In no way should the following examples be read to limit, or define, the entire scope of the disclosure.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A perforating gun, comprising:

a gun carrier;

a charge holder inside the gun carrier having a plurality of mounting holes for mounting respective shaped charges configured for being detonated with sufficient explosive energy to generate high-velocity fragments inside the gun carrier; and an impact sleeve inside the gun carrier configured for absorbing at least some energy of the high-velocity fragments, wherein the impact sleeve has a continuous undulating pattern of corrugated raised ridges that extends radially from one end of the gun carrier to an opposing second end of the gun carrier.

2. The perforating gun of claim 1, wherein the impact sleeve is radially positioned between the gun carrier and the charge holder to prevent a direct impact of the high-velocity fragments with the gun carrier.

3. The perforating gun of claim 1, wherein the impact sleeve is positioned radially inward of the charge holder.

4. The perforating gun of claim 1, further comprising:

a first alignment fixture at a first end of the gun carrier supporting a first end of the charge holder and a first end of the impact sleeve; and a second alignment fixture at a second end of the gun carrier supporting a second end of the charge holder and a second end of the impact sleeve.

5. The perforating gun of claim 4, wherein the alignment fixtures each comprise a shoulder for supporting the impact sleeve between the gun carrier and the charge holder.

6. The perforating gun of claim 4, wherein the alignment fixtures each comprise a central recess for supporting the respective end of the impact sleeve radially inward of the charge holder.

7. The perforating gun of claim 1, wherein the impact sleeve comprises a sleeve diameter and a plurality of raised features axially spaced along the sleeve and radially extending from the sleeve diameter.

8. The perforating gun of claim 7, wherein the raised features comprise work-hardened deformations of a parent material of the impact sleeve.

9. The perforating gun of claim 7, wherein the impact sleeve comprises a sheet of impact-absorbing material helically formed into a tubular shape of the impact sleeve.

10. The perforating gun of claim 7, wherein the raised features engage a diameter of the charge holder, thereby radially spacing the sleeve diameter from the charge holder.

11. The perforating gun of claim 1, wherein a parent material of the impact sleeve comprises a greater ductility than a parent material of the gun carrier.

12. The perforating gun of claim 7, wherein the raised features comprise a corrugated pattern of raised ridges.

13. The perforating gun of claim 12, wherein the corrugated pattern undulates radially along an axial direction.

14. The perforating gun of claim 12, wherein the raised ridges comprise a size or spacing selected based on an expected mean particle size or velocity of the high-velocity particles.

15. The perforating gun of claim 1, wherein the impact sleeve comprises a sheet with formed features helically rolled into a tube having a helical seam.

16. The perforating gun of claim 15, wherein the helical seam is bonded.

17. The perforating gun of claim 16, wherein the helical seam is bonded by welding.

* * * * *